US011125528B2

(12) United States Patent
Wood

(10) Patent No.: US 11,125,528 B2
(45) Date of Patent: Sep. 21, 2021

(54) MULTIPURPOSE BLEED-OFF PORT FOR A PAINTBALL MARKER

(71) Applicant: Planet Eclipse UK Limited, Manchester (GB)

(72) Inventor: Jack Kingsley Wood, Snelson (GB)

(73) Assignee: PLANET ECLIPSE UK LIMITED, Manchester (GB)

( * ) Notice: Subject to any disclaimer, the term of this patent is extended or adjusted under 35 U.S.C. 154(b) by 28 days.

(21) Appl. No.: 16/296,950

(22) Filed: Mar. 8, 2019

(65) Prior Publication Data

US 2019/0323794 A1 Oct. 24, 2019

Related U.S. Application Data

(60) Provisional application No. 62/661,180, filed on Apr. 23, 2018.

(51) Int. Cl.
*F41B 11/721* (2013.01)
*F41B 11/62* (2013.01)
*F41B 11/724* (2013.01)

(52) U.S. Cl.
CPC ..... *F41B 11/721* (2013.01); *F41B 11/62* (2013.01); *F41B 11/724* (2013.01)

(58) Field of Classification Search
CPC F41B 11/60; F41B 11/70; F41B 11/72; F41B 11/721; F41B 11/722; F41B 11/62; F41B 11/724
USPC ..... 124/71–77
See application file for complete search history.

(56) References Cited

U.S. PATENT DOCUMENTS

| | | | | | |
|---|---|---|---|---|---|
| 5,505,188 | A * | 4/1996 | Williams | F41B 11/52 | 124/49 |
| 5,673,679 | A * | 10/1997 | Walters | F41B 11/52 | 124/49 |
| 5,816,232 | A * | 10/1998 | Bell | F41B 11/53 | 124/51.1 |
| 6,739,323 | B2 * | 5/2004 | Tippmann, Jr. | F41B 11/53 | 124/48 |
| 7,275,530 | B2 * | 10/2007 | Deak | F41B 11/52 | 124/51.1 |
| 2002/0017287 | A1 * | 2/2002 | Rice | F41A 19/67 | 124/71 |
| 2003/0127084 | A1 | 7/2003 | Tippmann | | |
| 2007/0028908 | A1 | 2/2007 | Deak | | |
| 2008/0047537 | A1 | 2/2008 | Kulp et al. | | |

* cited by examiner

*Primary Examiner* — Jonathan C Weber
(74) *Attorney, Agent, or Firm* — Barlow, Josephs & Holmes, Ltd.

(57) ABSTRACT

The present disclosure is directed to an apparatus and method of directing a portion of a pressurize gas flow through a port in the breech after is leaves a bolt in a projectile launching device, such as a paintball marker, to perform additional functions in parallel with launching the projectile from the launching device. For example, the additional function can be a mechanism to prevent, or free, any potential bottlenecks of projectiles at that location when using a gravity fed hopper, for example. An agitating device is at least partially disposed in the outlet of a hopper. A bolt, having key groove or gas port, is configured to bleed air to a port in the breech that is used to fire a loaded projectile, the air is provided from a pressurized air source. An actuator moves the agitating device when air is bled through the key groove and the port.

10 Claims, 19 Drawing Sheets

MULTIPURPOSE BLEED-OFF PORT FOR A PAINTBALL MARKER

CROSS REFERENCE TO RELATED APPLICATIONS

This application claims benefit to prior filed U.S. Provisional Application No. 62/661,180, filed Apr. 23, 2018, incorporated by reference in its entirety herein.

FIELD

The present disclosure relates to a paintball marker systems and methods, and in particular to a bleed-off port for paintball marker accessories.

BACKGROUND OF THE INVENTION

In the sport of paintball and other sports for launching projectiles, a projectile launcher, such as a paintball marker, is used to propel spherical paintballs towards a target and a paintball loader, or hopper, is used to hold a quantity of paintballs and to supply those paintballs to the paintball marker. Traditionally, the paintball is fired with pressurized gas that is expelled through, for example, a bolt. In use, the paintball is loaded into the breech, the bolt is pressed against the paintball such that the face of the bolt is in contact with the rear of the paint ball. The air passed through the breech to force the paintball through the barrel of the marker. In prior art projectile launchers, such as paintball markers, the pressurized air that passes through the breech is only used to launch the paintball and provides no additional function. However, there remains a need in the art for additional uses for portions of the pressurized gas as it passes through the breech and/or after it leaves the breech.

Moreover, it has become advantageous to players participating in the sport to make use of more fragile paintballs. Such fragile paintballs require less force and kinetic energy in order to break upon impacting the intended target, which thus effectively increases the range of the paintball marker.

In traditional prior art systems 10, as shown in FIG. 1, a paintball hopper 26 is mounted above the paintball marker 12 and gravity is used to encourage paintballs 16*a*, 16*b*, 16*c* to transfer into the paintball marker. The problem with a loader of this type is that blockages often occur, and these blockages interrupt the continual supply of paintballs to the paintball marker. Such blockages can be a function of the paintballs becoming tightly packed around the feedtube 30 of the marker.

In more recent systems this problem has been addressed with the incorporation of various rotating devices into the paintball loader in order to push paintballs from the loader, compounding the effect of gravity and ensuring a continual supply of paintballs to the paintball marker. The issue with these types of loaders is that the rotating device can apply excessive amounts of force onto the queue or "stack" of paintballs and this force can cause fragile paintballs to fracture and break in the loader, feed, or marker.

In such alternative paintball loaders, or loading devices, rotating devices, or springs, are used to push paintballs into the marker and in this type of loading device the amount of force applied to the stack of paintballs is significantly increased, thus increasing the chance of broken paintballs. Further, in rotating devices, there persists issues that accompany increasing the complexity of the system. These systems can also incorporate motors, batteries, and electronics that can increase the cost of the loader as well as the complexity.

With the addition of more moving parts and added electronics, the potential for any one, or more, of those parts to break increases. Such a malfunction can be detrimental if the device is being used during a tournament where the reliability of equipment is paramount.

For the foregoing reasons, there is a need for a system and method for loading paintballs that reduces the force exerted upon the paintballs and is able to reduce the blockages that plague prior art gravity loaders and is able to move the paintballs with the assistance of gravity and without the added complexity of motors or electronics.

SUMMARY OF THE INVENTION

The present disclosure is directed to an apparatus and method of directing a portion of a pressurized gas flow through a port in the breech in a paintball marker to perform additional functions, or actuate additional accessories, in parallel with launching the paintball from the paintball marker—all without any added tubing between the pressurized air source and the barrel of the marker. For example, the diverted gas flow can be used to actuate a counter to detect a "firing pulse" to ensure an accurate count of the remaining paintballs or number of paintballs fired.

The present disclosure is further directed to an apparatus and a method of transferring paintballs to the paintball marker in a way that reduces the forces exerted upon the paintballs, facilitating the use of more fragile paintballs, and in a way that blockages of paintballs can be eliminated and for paintballs to be loaded with a gravity-based transfer system. For example, a loader can agitate the paintballs in a loader, or hopper, each time the marker is fired without using any electronics or batteries, or additional hosing to re-direct the exhaust air to activate an agitator.

The present disclosure proposes to use the air that is used to fire the paintball to actuate any number of devices directly or indirectly. For example, the present disclosure proposes to actuate a device in the loader to move the balls to stop them from jamming in and around the loader exit port, all without the additional tubing or hosing from the marker or pressurized air source.

BRIEF DESCRIPTION OF THE DRAWING FIGURES

The novel features that are characteristic of the present disclosure are set forth in the appended claims. However, the disclosure's preferred embodiments, together with further objects and attendant advantages, will be best understood by reference to the following detailed description taken in connection with the accompanying drawings in which:

DESCRIPTION OF THE INVENTION

Certain exemplary embodiments will now be described to provide an overall understanding of the principles of the structure, function, manufacture, and use of the device and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present disclosure. Further, in the present disclosure, like-numbered components of the embodiments generally have similar features, and thus within a particular embodiment each feature of each like-numbered component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape. Further, to the extent that directional terms like proximal, distal, top, bottom, up, or down are used, they are not intended to limit the systems, devices, and methods disclosed herein. A person skilled in the art will recognize that these terms are merely relative to the system and device being discussed and are not universal. Further, for ease of discussion, the present invention is discussed in connection with paintball markers but the invention is also related and applicable to other projectile launching devices, such as airsoft guns.

Figure 1:
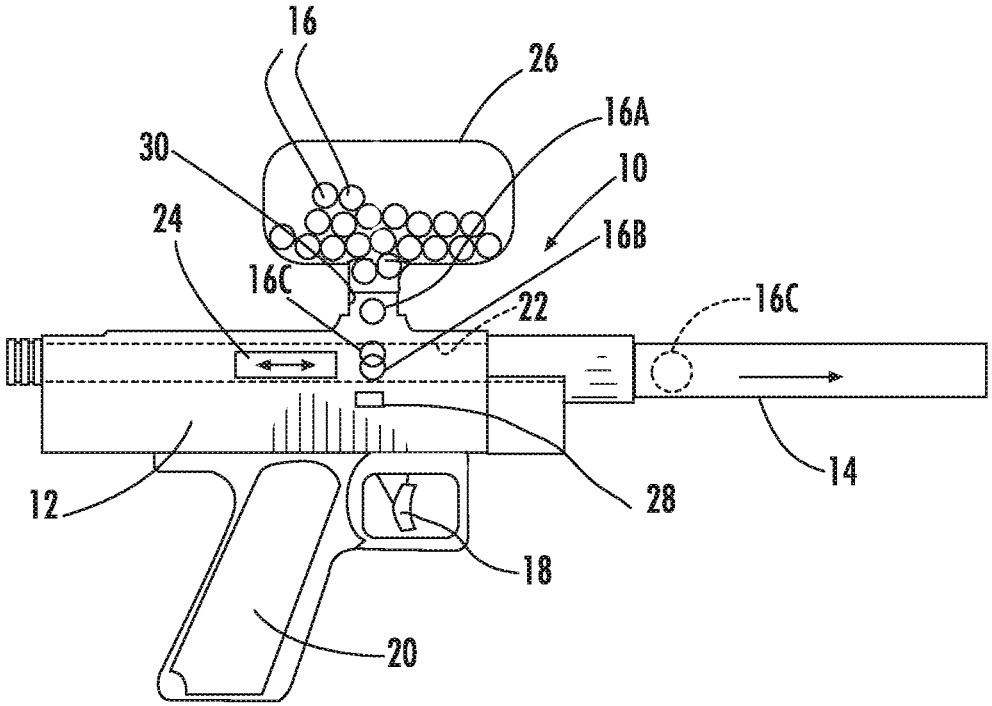
FIG. 1 PRIOR ART
FIG. 1 is a prior art paintball marker having a gravity-fed hopper.

In the prior art, it is well known to use compressed, or pressurized air to launch a paintball 16 through a paintball marker 10, as shown in FIG. 1. However, that pressurized air is often only used for the specific purpose of loading and launching the paintball. If the pressurized air is used for other purposes, additional tubing, or hoses, are used to divert that air before the air enters the breech 22. This additional tubing often requires substantive modifications to the paintball marker 10 and can introduce additional points of failure for the device. Further, such a modified paintball marker 10 may require the pressure of the air source to be increased to accommodate the additional accessory being actuated. Thus, the modified paintball marker may require more air to be used each time the paintball marker fires, making the paintball marker less air efficient. This results in the paintball marker requiring a larger air supply. Moreover, higher pressures of compressed air, or gas, can put higher stresses on the device and can lead to yet another source of failure.

Figure 2A:
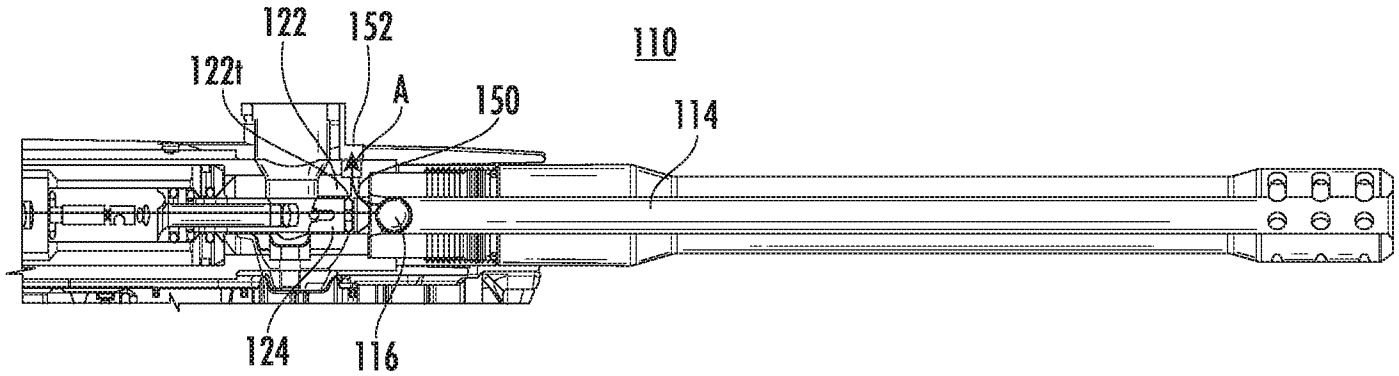
FIG. 2A is a partial sectional view of a paintball marker according to a first embodiment.

The present disclosure seeks to provide a port 150 which is in operative connection with the breech 122 of the marker 110 to provide additional functionality to the marker without any additional tubing, as shown in FIG. 2A. Of note, FIG. 2A is merely a partial view of a paintball marker 110, in which the breech 122 and the associate port 150 are shown, for the sake of simplicity. Such a port 150 can be used in any type of marker 110 in any location along the pressurized air path 152 as will be discussed below. The illustrated configuration is but one embodiment understood to be within the scope of this disclosure. The port 150 can provide a pathway 152 for a small percentage of compressed air A, which is normally exclusively used to advance a projectile 116 through a barrel 114, to be bled off for other uses. In the illustrated embodiment, the port 150 is disposed in the top **122*t* of the breech 122 of the marker 110, however, the port 150 can be disposed anywhere along the body, breech, or barrel. The port 150 can be disposed proximate the bolt 124 when the bolt 124, and the associated projectile or paintball 116, are in the "loaded" configuration. In the illustrated embodiment, the bolt 124 can include a key-way, not shown, see e.g. FIG. 5, which can permit a small percentage of the compressed air to be directed through to the port 150 in the wall of the breech 122. In some embodiments, there can be one or more additional ports disposed throughout the breech, barrel, or other portions of the marker. The compressed gas A which is bled through the port 150** can be used to actuate a variety of add-on, or built in, accessories.

Figure 2B:
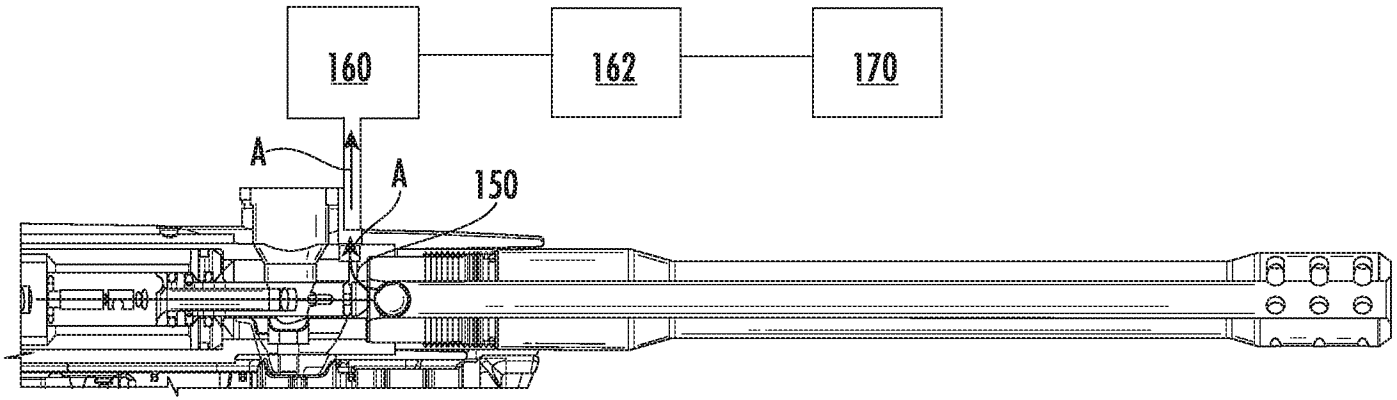
FIG. 2B is a functional diagram of one embodiment of the paintball marker of FIG. 2A.
Figure 2C:
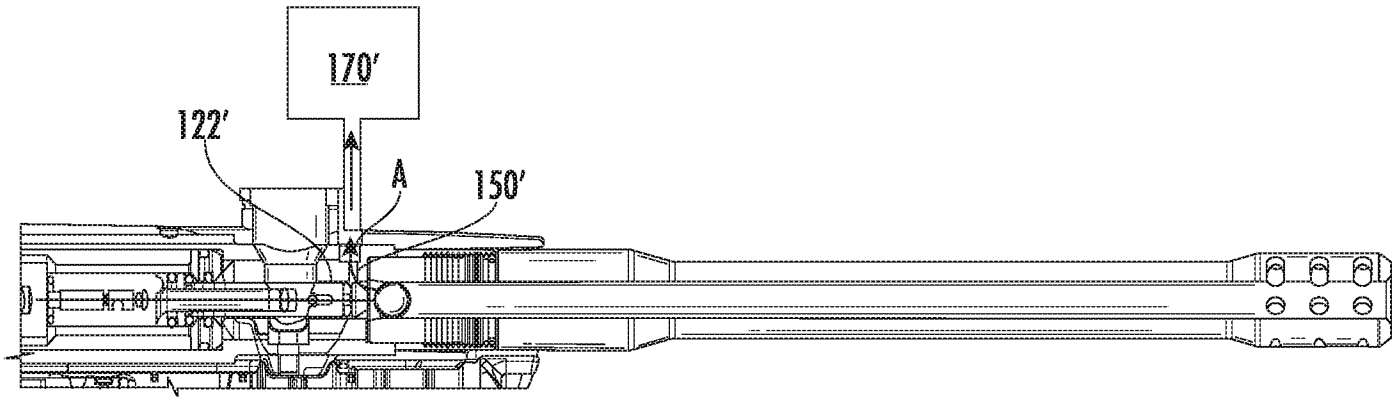
FIG. 2C is a functional diagram of second embodiment of the paintball marker of FIG. 2A.

In some embodiments, as shown in FIGS. 2B and 2C, the bleed off port can be used to actuate one or more add-ons. In some embodiments, the port can either directly, or indirectly, actuate any of the add-ons 170 disclosed herein and others not explicitly provided for herein. For example, the port can be arranged so that the pulse of compressed air can be detected by an electronic sensor 160, shown in FIG. 2B, or a mechanical actuator 170', shown in FIG. 2C. In some embodiments, as shown in FIG. 2B the sensor 160 may provide an electronic signal which can be sent to any number of additional add-ons 170. For example, the sensor can be operatively coupled to a computer, CPU, and associated memory, storage, processor, interface, and a power supply. The CPU can then send along a command to an associated add-on 170. This use of the port 150 can be considered to be an indirect actuation of an add-on 170. The sensor 160 can include a pneumatic actuator (not shown) which moves, or is triggered, by the small percentage of air A that leaks through the port 150. Alternatively, the sensor 160 can be an optical sensor (not shown) which can detect the pulse of air with the use of a break beam optical sensor or a proximity sensor. The sensor 160 can then be used to activate, indirectly, any number of switching devices or sensors that are part of an electronic circuit, or CPU 162. For example, the electronic signal can be used to actuate a shot counter, drive signal for an electronic loader, ball jam detection, etc. For example, the sensor 160 can, be used to count the number of times the bolt has actuated, or the number of paintballs that has been used. In some embodiments, the signal can be used to actuate one or a combination of add-ons.

As noted above, the pulse of air escaping through the port 150' can be used for direct pneumatic actuation of various attachments or add-ons, as shown in FIG. 2C. For example, the port 150' can be situated so as to provide pressurized gas to a pneumatically actuated add-on 170' to actuate a jiggler plate, or rubber plate, to provide agitation within a gravity fed projectile or paintball hopper, as will be discussed further below. Alternatively, the port 150' can be situated to actuate a mechanically operated magazine feed system, a mechanical shot counter, and/or reset a fire-control system. The fire-control system can be used in certain tournament or game play scenarios to ensure that the marker can only fire after it has been actuated by the pneumatic actuator 170' to ensure that no automatic actuation of the marker is occurring. Advantageously, the exemplary port 150' can permit the use of additional accessories 170' which are actuated or "powered" by pressurized gas from the breech 122' without the need for added tubing from the pressurized gas source or other ports upstream of the breech 122'.

In one exemplary embodiment, the port 250 can be used to actuate a plate 270 which can be used to aid in the advancement of gravity fed paintball markers 216. Such an actuator can overcome many of the problems associated with gravity fed paintball hoppers. By way of background, in the prior art, it is well known to feed paintballs individually from a hopper which is commonly gravity fed. As seen in FIG. 1, a prior art paintball marker 10 is generally shown to include a main body 12 with a grip 20, trigger 18, and barrel 14. Within the main body 12 is a breech 22 with a bolt 24 that actuates back and forth therein. The bolt 24 is retracted to allow a paintball 16 at position 16A to enter the breech 22 from a supply of paintballs in a gravity-fed hopper 26, for example, via feedtube 30, in preparation for launching. Once the ball 16 is within the breech 22 as shown at position referenced as 16B, the bolt 24 can be moved forward, as is well known in the art, to prevent further projectiles from entering the breech 22. Then, the projectile 16 within the breech can then be launched in the normal fashion from the barrel 14 at position 16C, such as by the delivery of a blast of compressed air behind the projectile 16. The compressed air that passes through the breech and the bolt is limited in use to advance the projectile 16 through the barrel.

As noted above, common issues with gravity fed hoppers include the paintballs becoming stuck, or jammed, at the mouth of the hopper or in the feed outlet. This can be the result of packing of the paintballs at that location, where the paintballs become stuck due to inefficient packing or friction at those locations. The present disclosure additionally seeks to provide simplified mechanisms to prevent, or free, any potential bottlenecks of paintballs at that location when using a gravity fed hopper, for example. This is one application or use of the unique bleed off gas port of the present invention.

FIGS. 3-9 show a first embodiment of the add-on apparatus and method of use of the present invention. The first embodiment employs the use of a jiggler plate 280 which is designed to keep the paintballs 216 moving in the loader/hopper 226 and to prevent them from jamming together around the feed outlet 230. While a jiggler plate 280 is shown, the principle of using the disclosed actuator 270 could be used to operate a number of different types of devices, such as a paddle, lever, or arm.

Figure 3:
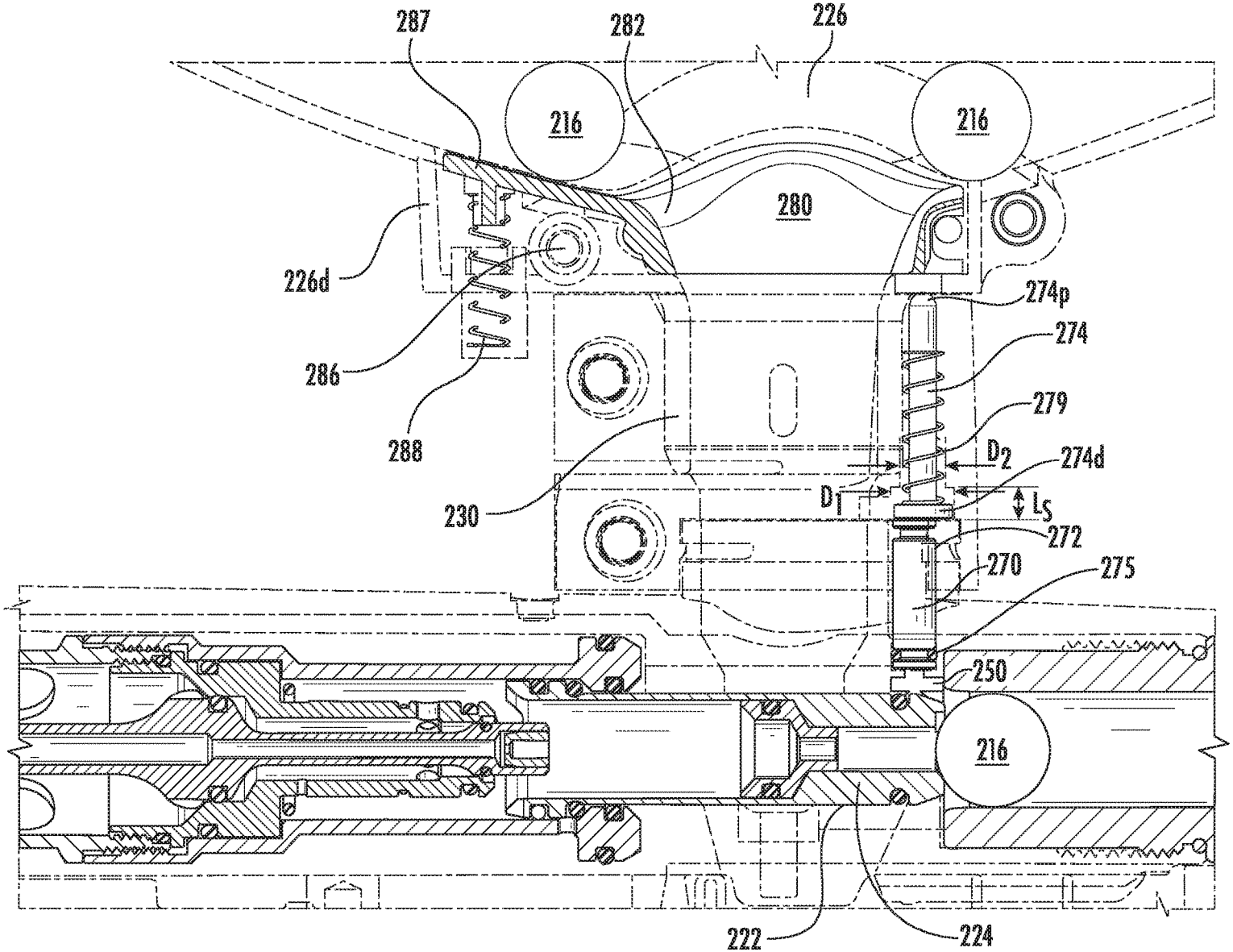
FIG. 3 is a cross-sectional view of a first embodiment of a paintball marker loading system in a first configuration.
Figure 7:
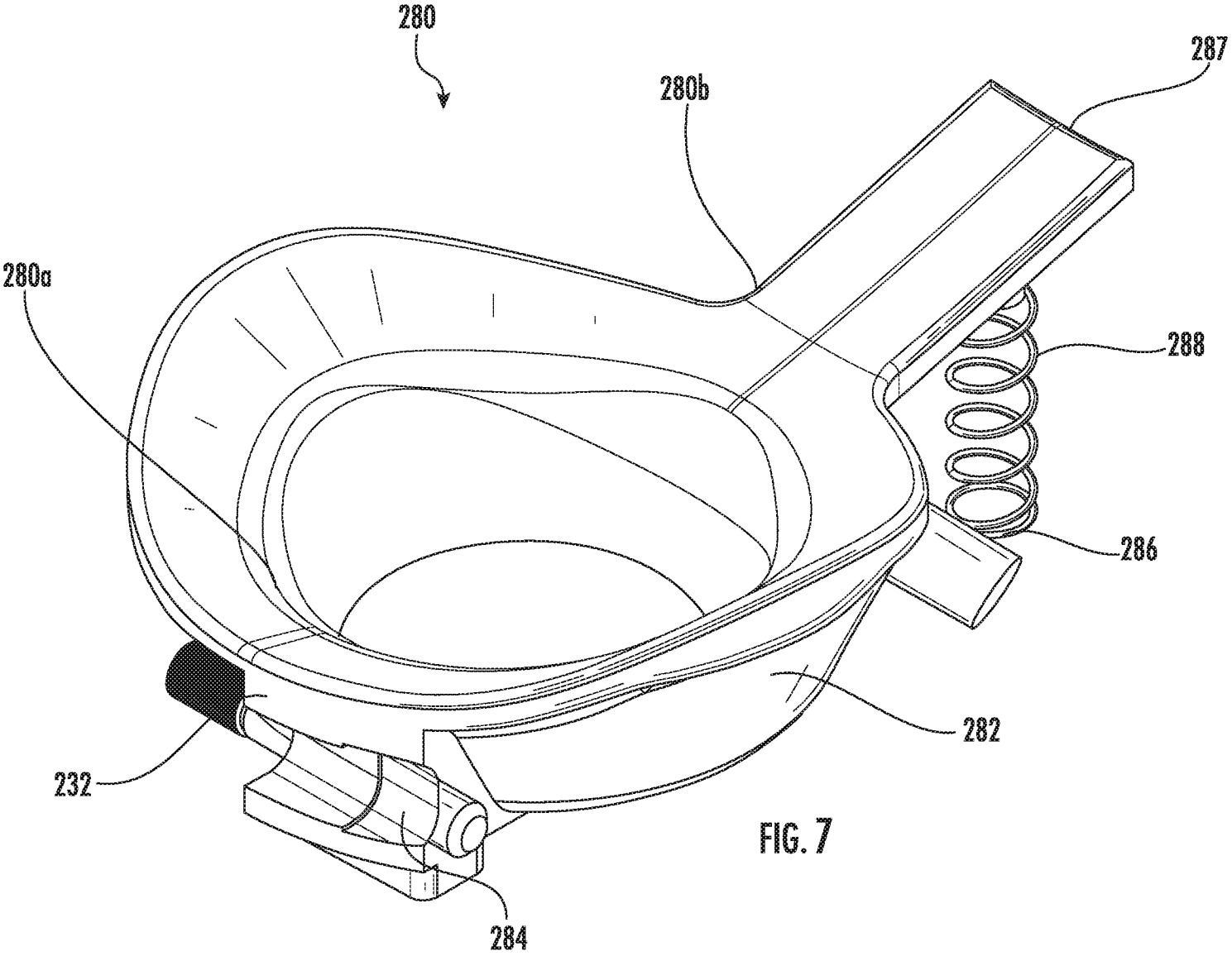
FIG. 7 is a perspective view of the jiggler plate.
Figure 8:
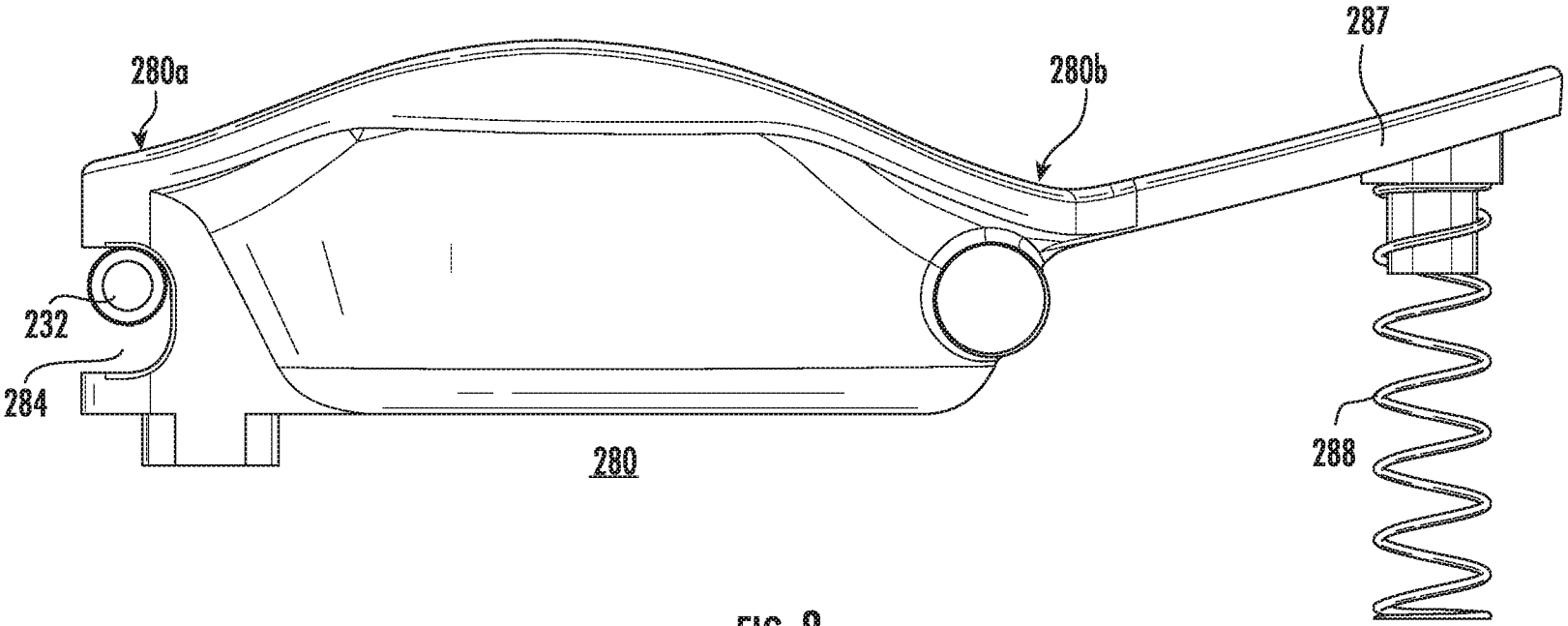
FIG. 8 is a side view of the jiggler plate of FIG. 7.
Figure 9:
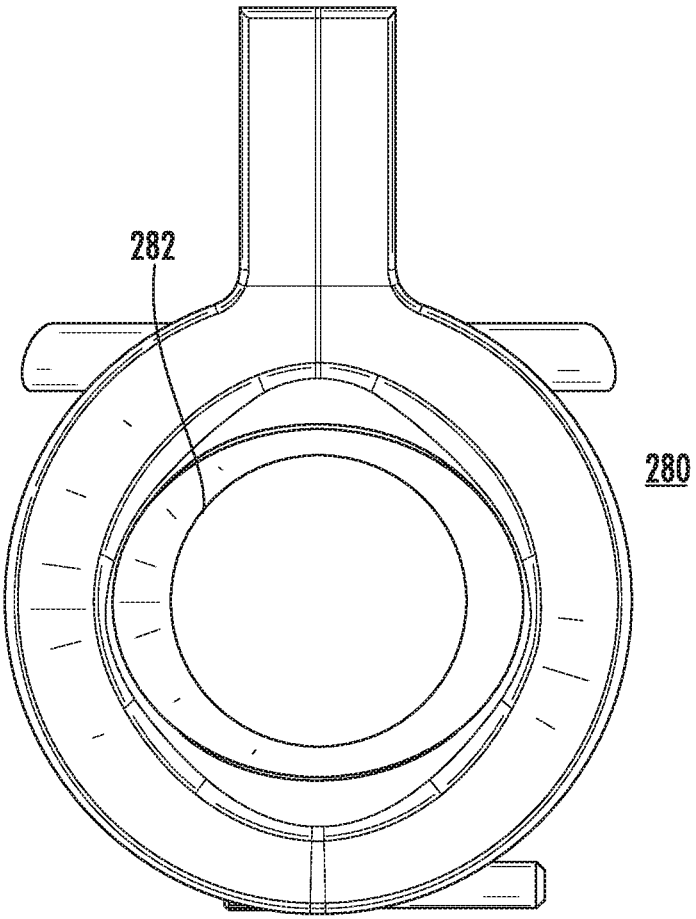
FIG. 9 is a top view of the jiggler plate of FIG. 7.

FIG. 3 shows the parts of an embodiment of the system at "rest". The hopper 226 can be similar to the gravity fed loader 26 of FIG. 1 and can have a distal opening 226*d* in communication with a feedtube 230. The distal opening 226*d* of the hopper can have a jiggler plate assembly 280, or agitating device, disposed therein. The jiggler plate assembly 280 can have a generally cylindrically, or funnel, shaped body 282 having a decreasing diameter as the jiggler 280 depends distally towards the feedtube 230, as shown in FIGS. 7-9. The jiggler plate 280 can be sized such that it is substantially the same as the interior surface of the mouth of the feedtube 230 to prevent the jiggler plate from sliding too much, or having a range of motion which can break or damage the paintballs 216.

The movement of the jiggler plate 280 can be controlled by means of the actuator 270. The actuator 270 can be a mechanical actuator which is advanced proximally within a through-hole 272 to engage a pin 274. The pin 274 can have a proximal end 2'74*p* which can interface with the plate 280 and a distal pin head 274*d*. The proximal end 2'74*p* of the pin can be disposed in a portion of the through-hole 272 having a diameter $D_1$. The distal pin head can be disposed in a second portion of through-hole 272 having a diameter $D_2$, where $D_2$ is larger than $D_1$ thus defining a shoulder interface 273. The head of the pin 274*d* can have a diameter that is larger than $D_1$ such that the upward movement of the pin 274 is restricted when it abuts the shoulder 273, thereby defining the length of the stroke $L_S$ of the actuator 270. In the illustrated embodiment, the actuator 270 and the pin 274 are axially offset. Alternatively, the actuator 270 and the pin 274 can be coaxial. Further, the actuator 270 and the pin 274 can have any cross-sectional shape. Movement of the pin 274 can actuate the jiggler plate 280. The proximal end of the pin 274 interfaces with the hopper at a first side 280*a* of the jiggler plate 280.

Figure 6:
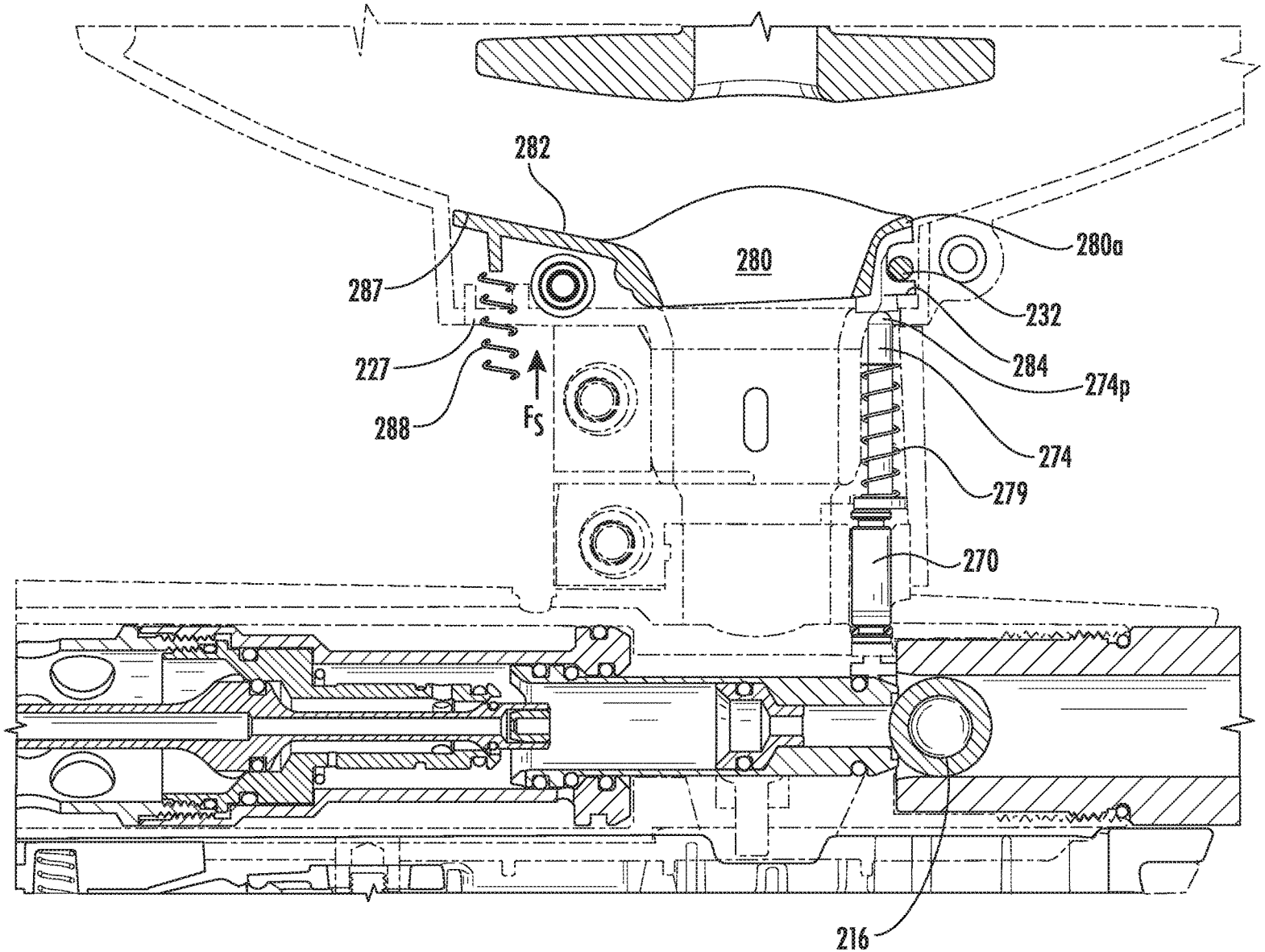
FIG. 6 is cross-sectional view of the paintball marker loading system of FIG. 3 in a second configuration

The jiggler plate 280 can be slidably retained in the distal opening 226*d*, or mouth, of the hopper 226 by a horizontal pin 232 disposed in a C-shaped groove 284 extending along the first side 280*a* of the plate 280. On the other second end 280*b* of the jiggler plate 280, or 180 degrees offset, a pivot pin 286 can be disposed to permit the jiggler plate 280 to pivot. Extending from the side of the jiggler plate 280, a spring plate 287 and a spring 288 can extend from the spring plate 287, as shown in FIGS. 7-9. The spring 288 can be retained in a through hole 227 in distal most surface of the hopper 226, as shown in FIGS. 3 and 6. The spring 288 can apply a force $F_S$ on the jiggler plate 280 to translate proximally and distally, relative to the hopper 226, to move the paintballs 216 into a proper orientation. This actuation position as shown in FIG. 6, as seen compared to the resting position of FIG. 3, can be achieved through movement of an actuator which interfaces with the jiggler plate at a location below the C-shaped groove a distance $L_s$.

In an exemplary embodiment, as shown in FIGS. 3-9 and introduced above, an actuating assembly can include a pin 274 and an actuator 270. The pin 270 can be retained in a channel 272 of the feedtube 230. The pin 274 can include a distal head 274*d*, or disc, at a distal end thereof having a larger diameter than the body of the pin 274. The distal head of the pin 274*d* can have a diameter which is substantially similar to the diameter of the channel 272 in the feedtube 230. Surrounding the pin 274 can be a spring 279 which can engage the head 2'74*p* of the pin to force the pin in a distal direction D such that it is not engaging the jiggler plate 280. The pin 274 can translate proximally and distally upon movement of the actuator 270 such that the proximal tip of the pin 274*p* engages the jiggler plate 280.

The actuator itself 270 can be a mechanical actuator having a generally cylindrical with a circumferential groove 271 disposed at a distal end 270*d* thereof. The actuator can be disposed in a channel, or through hole, 272 extending through the feedtube 230 and the body of the paintball marker 210. For example, the actuator channel 272 can be open to and in fluid communication with the interior of the barrel 214 or breech 222 through the port 250. Pressurized gas A which can be passed through the port 250 can thus directly apply a pressure to the mechanical actuator 270 as will be discussed further below. Returning to the actuator 270, an o-ring 275 can be disposed in the groove 271 such that there is a fluid tight seal between the distal end of the actuator 270*d* and the channel 272. Alternatively, the actuator can have a portion at the distal end 270*d* which has a larger diameter such that it creates a fluid tight seal with the channel 272. The fluid tight seal can allow for a fluid to enter the distal end of the channel proximate the port 250, from the breech or barrel, to push or force the actuator 270 upward. Alternatively, the pin 274 and actuator 270 can be a single piece.

Figure 4:
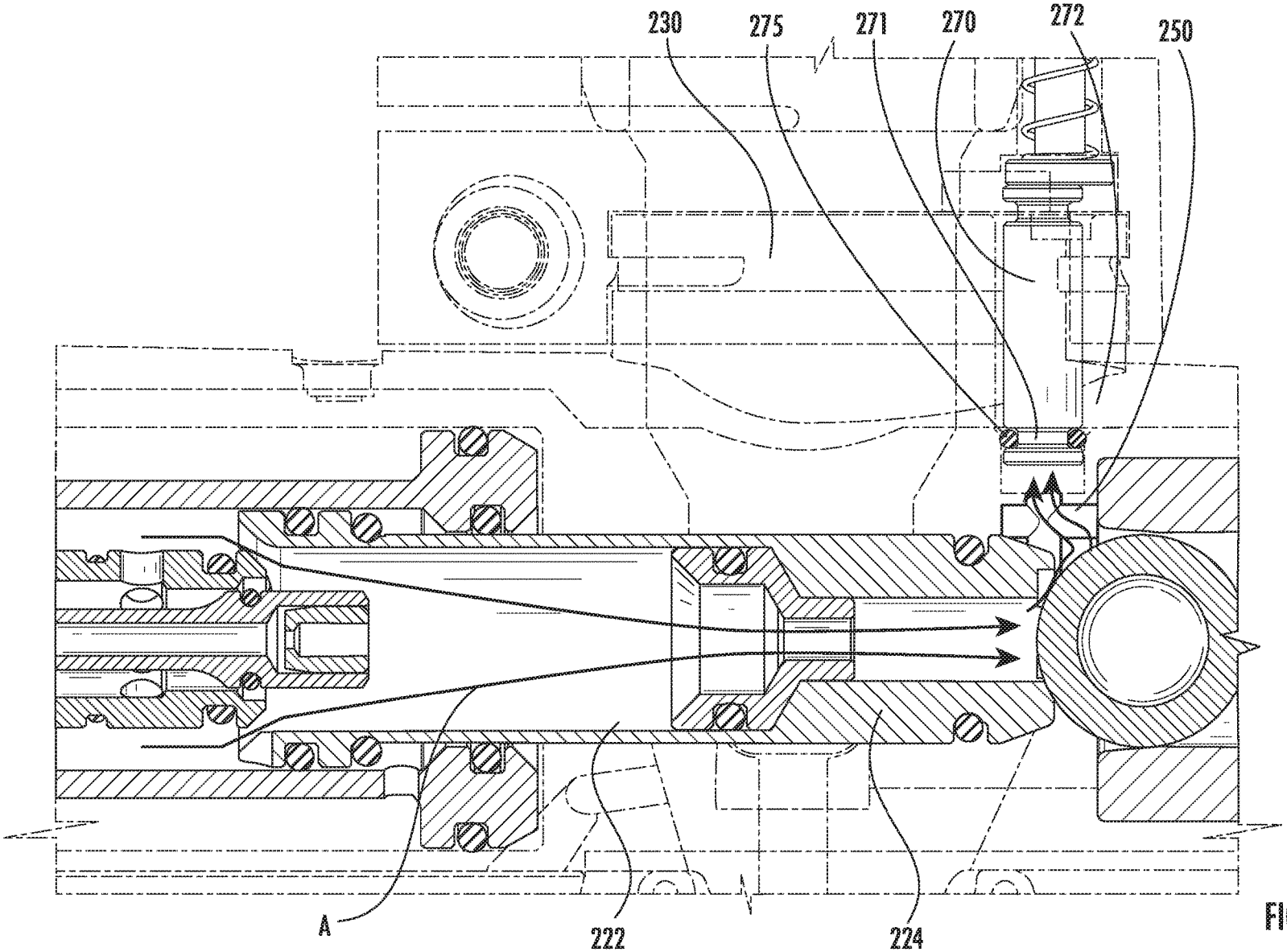
FIG. 4 is a cross-sectional view of the paintball marker loading system of FIG. 3 showing the flow path of an exhausted fluid.
Figure 5:
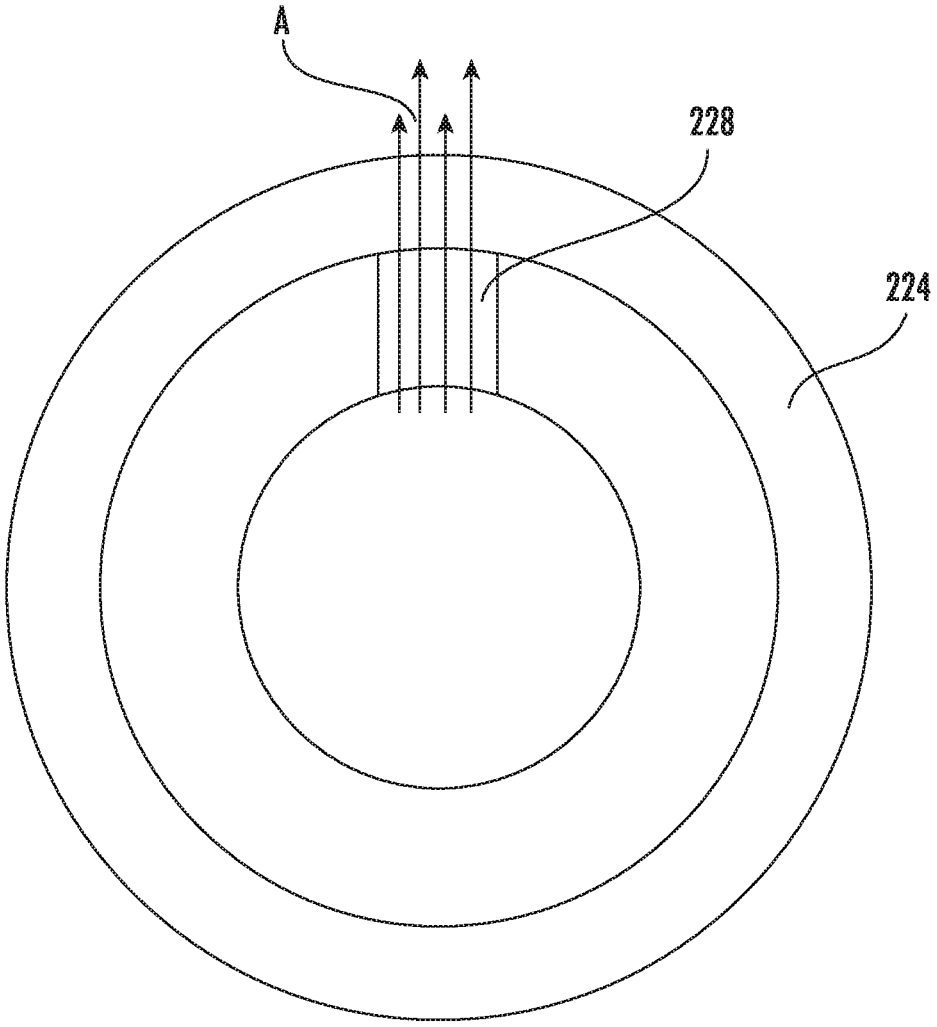
FIG. 5 is a front view of the bolt of the paintball marker loading system of FIG. 3.

For example, in use, as shown in FIG. 4, the air A that is released through the bolt to the back of the ball can be directed by a key groove 228 on the bolt 224, as shown in FIG. 5, to direct a limited amount of air towards the port 250. The directed percentage of air A can create a pressure on the bottom of the actuator 270, to force the actuator upwards. The gas port 250 can be disposed in the upper portion of the barrel 214 as noted above. Alternatively, an additional port can be included to use the bled off air to another actuator, either mechanical or electrical. The pilot hole 250 and the key 228 can provide for an intentional, and directed, leak of air A out of the breech 222 without additional tubing, shown in FIG. 5 as arrows, into the port 250 in the breech 222 to direct the air A into the actuator channel 272 to urge the actuator 270 to move against the spring pressure of the actuator 270 and jiggler plate 280, as seen in FIG. 6. Advantageously, this arrangement obviates the need for any additional tubing, between the air source and the breech, to direct pressurized air from the pressurized air source to the actuator. Once the ball 216 has been fired and the pressure in the barrel 214 and the breech 222 drops to atmospheric pressure the actuator spring 279 and jiggler plate spring 288 will push the actuator 270 back downwards to its resting position, as shown in FIG. 3.

FIGS. 10-15 show a second, alternative, embodiment of the apparatus and the above method of the present invention that can employ the unique bleed off gas port of the present invention. In the alternative embodiment, in place of a rigid jiggler plate 280, a rubber plate 380 can be used. The exemplary rubber plate 380 can be designed to keep the paintballs 316 moving in the loader 326 and to prevent them from jamming together around the feed outlet 330.

Figure 10:
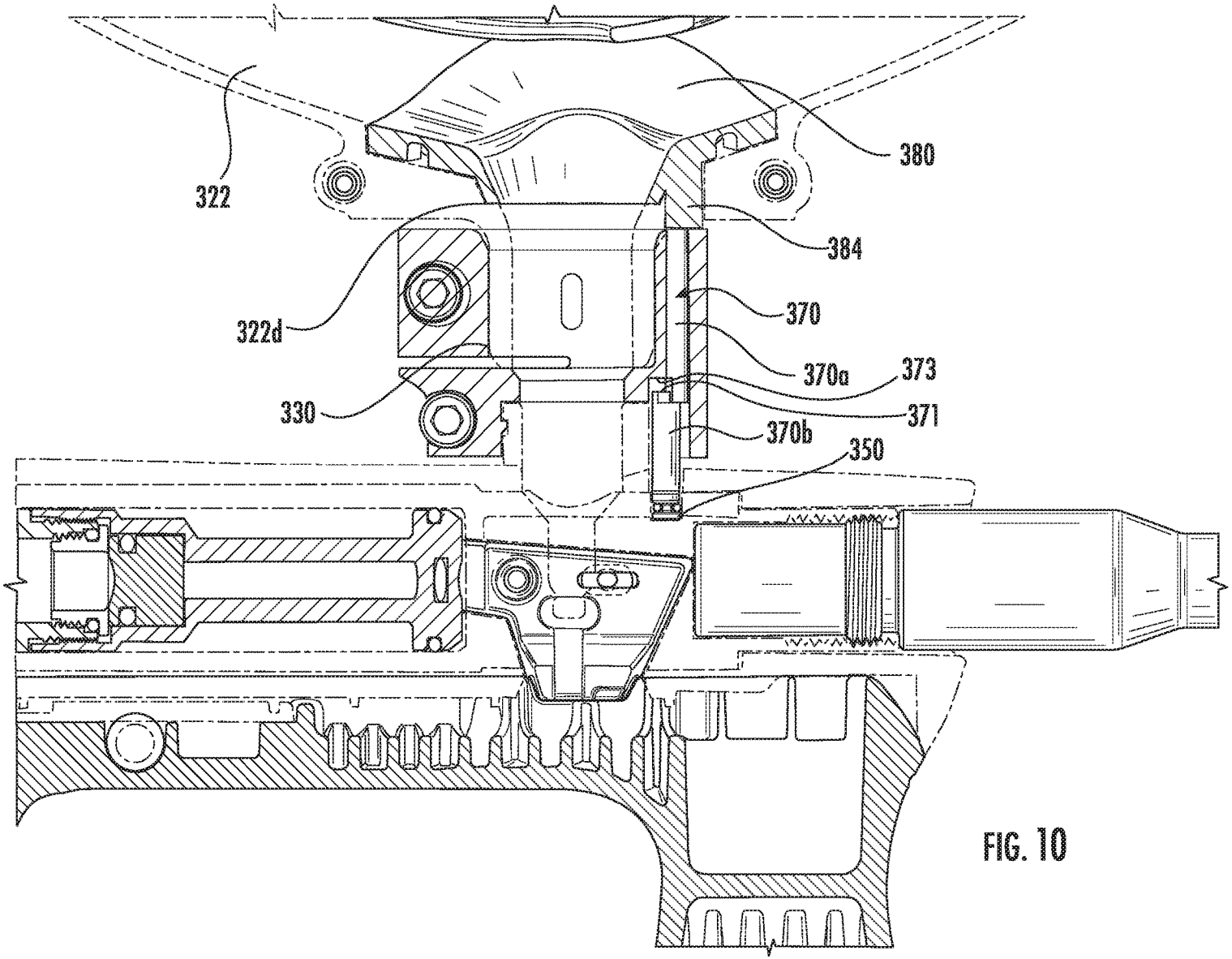
FIG. 10 is a cross-sectional view of a second embodiment of a paintball marker loading system in a first configuration.
Figure 11:
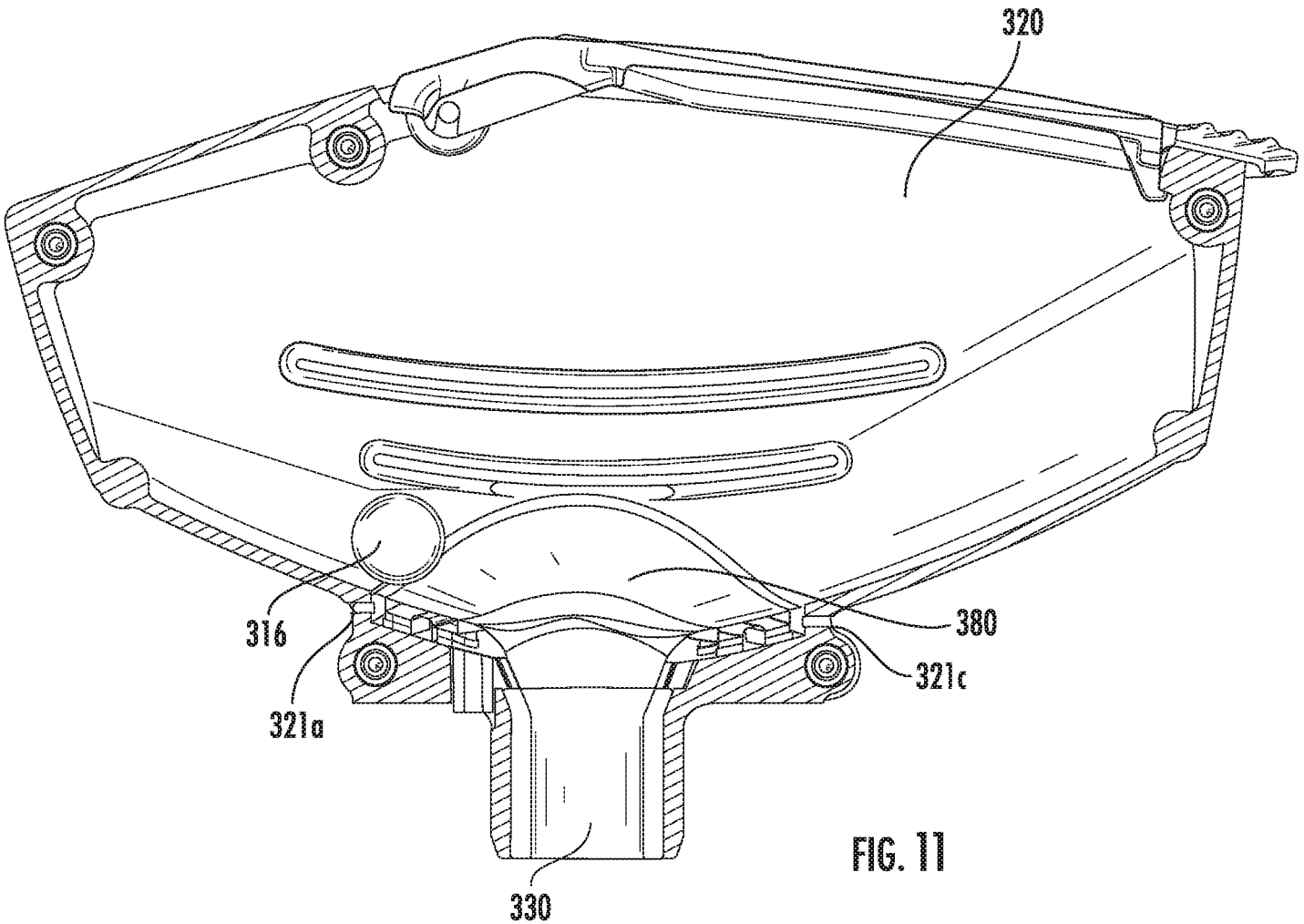
FIG. 11 is a cross-sectional view of the hopper of FIG. 10.
Figure 12:
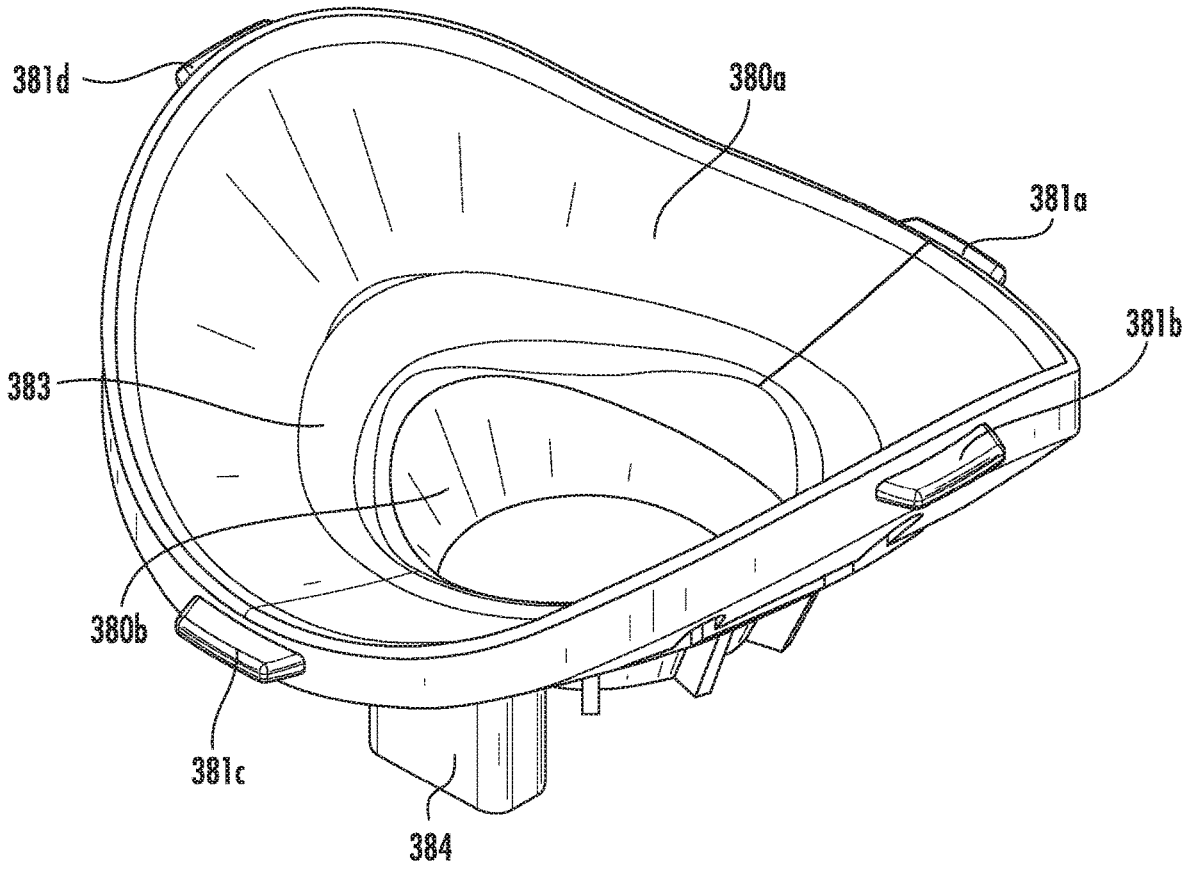
FIG. 12 is a perspective view of the rubber plate of the second embodiment of the paintball marker loading system of FIG. 10.
Figure 13:
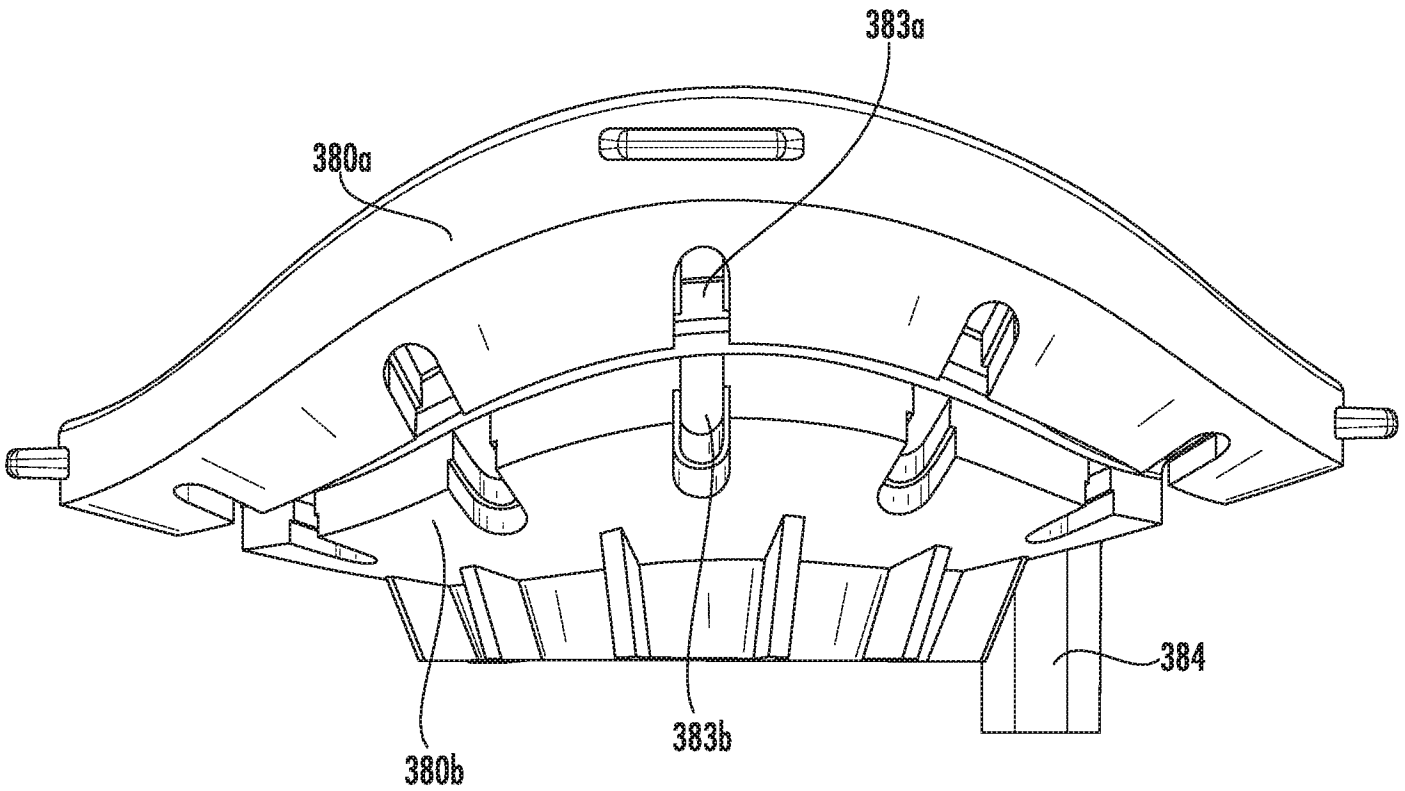
FIG. 13 is a side view of the rubber plate of FIG. 12.
Figure 14:
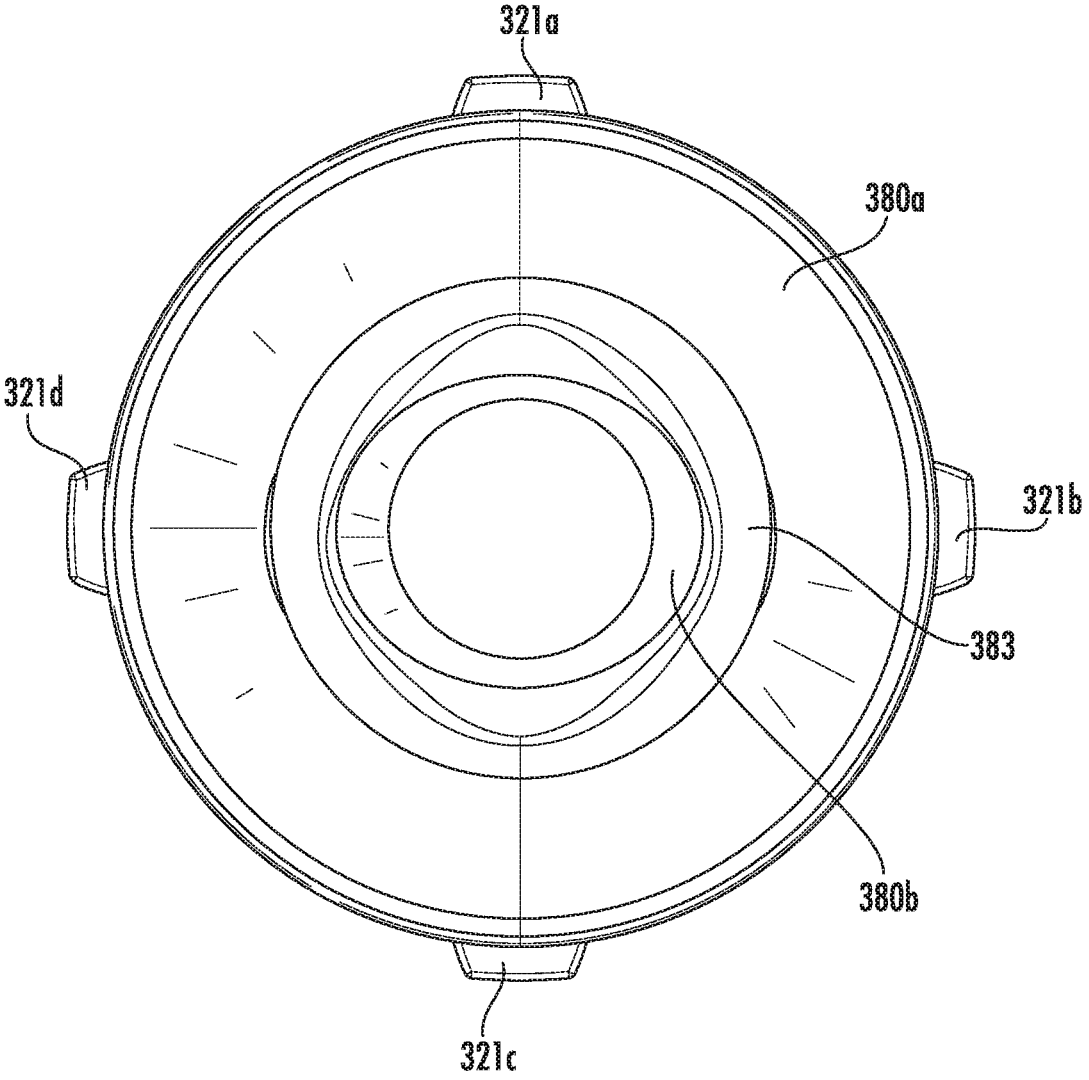
FIG. 14 is a top view of the rubber plate of FIG. 12.
Figure 15:
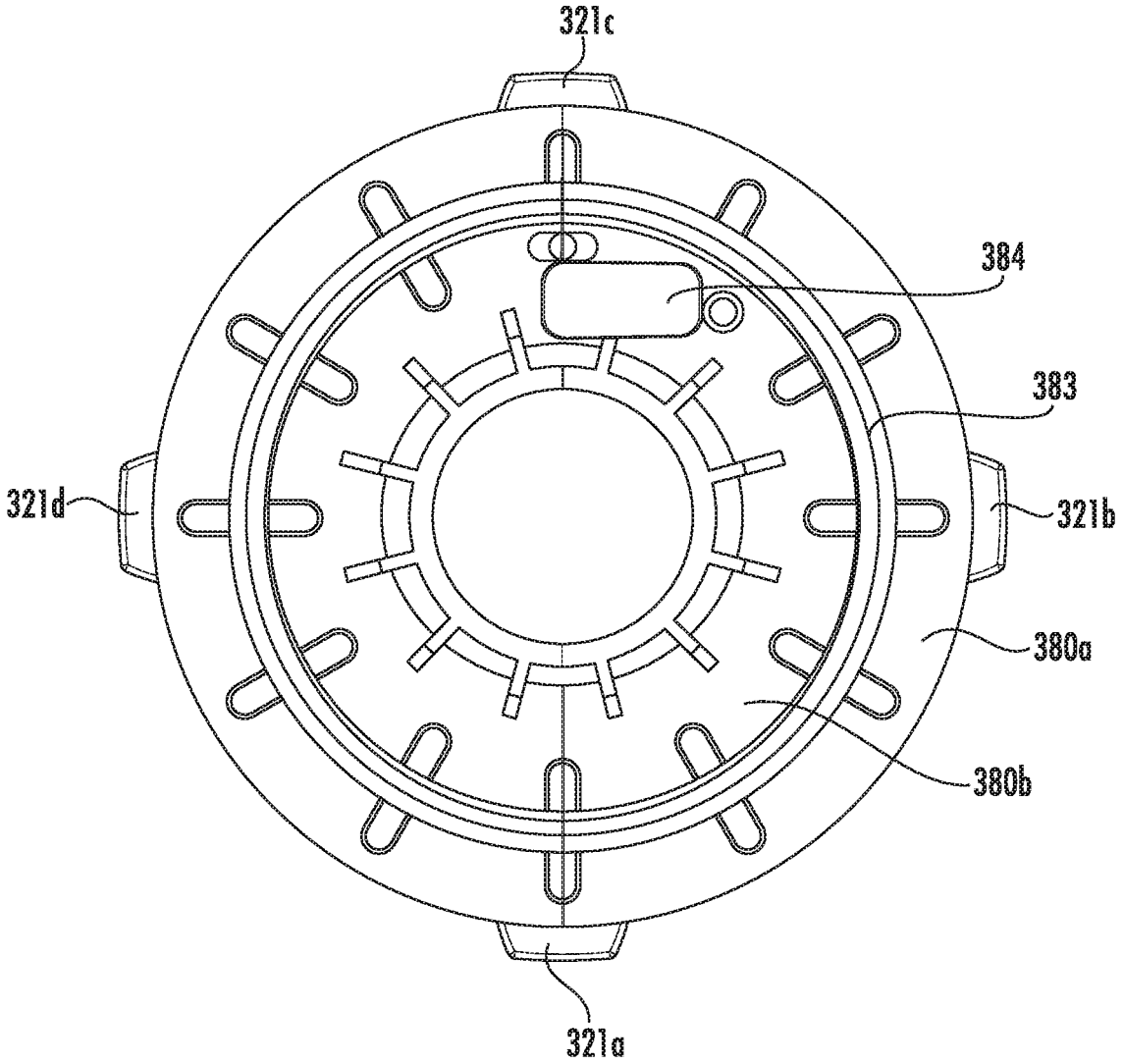
FIG. 15 is a bottom view of the rubber plate of FIG. 12.

FIG. 10 shows the parts of the embodiment of the system at "rest." The hopper 322 can be similar to the gravity fed loader of FIG. 1 and can have a distal opening 322*d* in communication with a feedtube 330. The distal opening 322*d* of the hopper 322 can have a rubber plate assembly 380, or agitating device, disposed therein. The rubber plate 380 assembly can be generally cylindrically, or funnel, shape having a decreasing diameter as the rubber depends distally towards the feedtube 330, as shown in FIGS. 10 and 11. The rubber plate 380 can be sized such that it is substantially the same as the interior surface of the mouth of the feedtube 330 to prevent the rubber plate from stretching too far. The rubber plate 380 can include an outer fixed plate 380*a* which can be fixed to the hopper 322 by any suitable means. For example, the fixed plate 380*a* can be integral with the hopper or can be fixed with adhesives or mechanical fixation means. In the illustrated embodiment, the fixed plate 380*a* includes four tabs 381*a*, 381*b*, 381*c*, 381*d*, or fingers which can be received in respective grooves 321*a* and 321*c* on the hopper 322. Extending radially inwardly from the fixed plate 380*a* a rubber diaphragm 383 can be attached to the fixed plate 380, and inward of the rubber diaphragm 383, a movable plate 380*b* can be disposed. An outer lip 383*a* of the rubber diaphragm can be received in a groove in the radially inward face of the fixed plate and an inner lip 383*b* of the rubber diaphragm 383 can be disposed in a groove in the radially outward face of the movable plate 380*b*. The rubber diaphragm 383 can permit the moveable portion 380*b* to elastically translate relative to the fixed portion 380*a* to re-orient, or shuffle, paintballs 316 in the hopper 322 to prevent the paintballs 316 from jamming as it moves upward and downward relative to the fixed plate. This actuation can be achieved through movement of an actuator 370 which interfaces with the rubber plate 380 at an actuator contact 384 which can be located below the moveable plate 380*b*.

The actuator 370 can be a single, integral piece, as shown. The single piece can have a first section 370*a* which is proximate the port 350, and a second section 370*b* which is proximate the rubber plate 380. The first section 370*a* and the second section 370*b* can both have substantially circular cross-sections; however, other cross-sectional shapes are within the scope of this disclosure. Further, the first section 370*a* can be axially offset from the section 370*b* such that a shoulder 371 is created to prevent the actuator from exceeding a predefined upper limit on the stroke length of the actuator 370. The shoulder 371 can abut a cut out 373 in the through hole 372. In place of a spring as used in the embodiment of FIGS. 3-9, the rubber diaphragm 383 itself can function as a spring to bias the moveable plate 380*b* into a "rest" configuration which will in turn bias the actuator downward relative to the hopper without the need for an additional spring. The actuating assembly 370 can be substantially similar to the actuating assembly of FIGS. 3-9 and a description thereof will be omitted for the sake of brevity.

Figure 16:
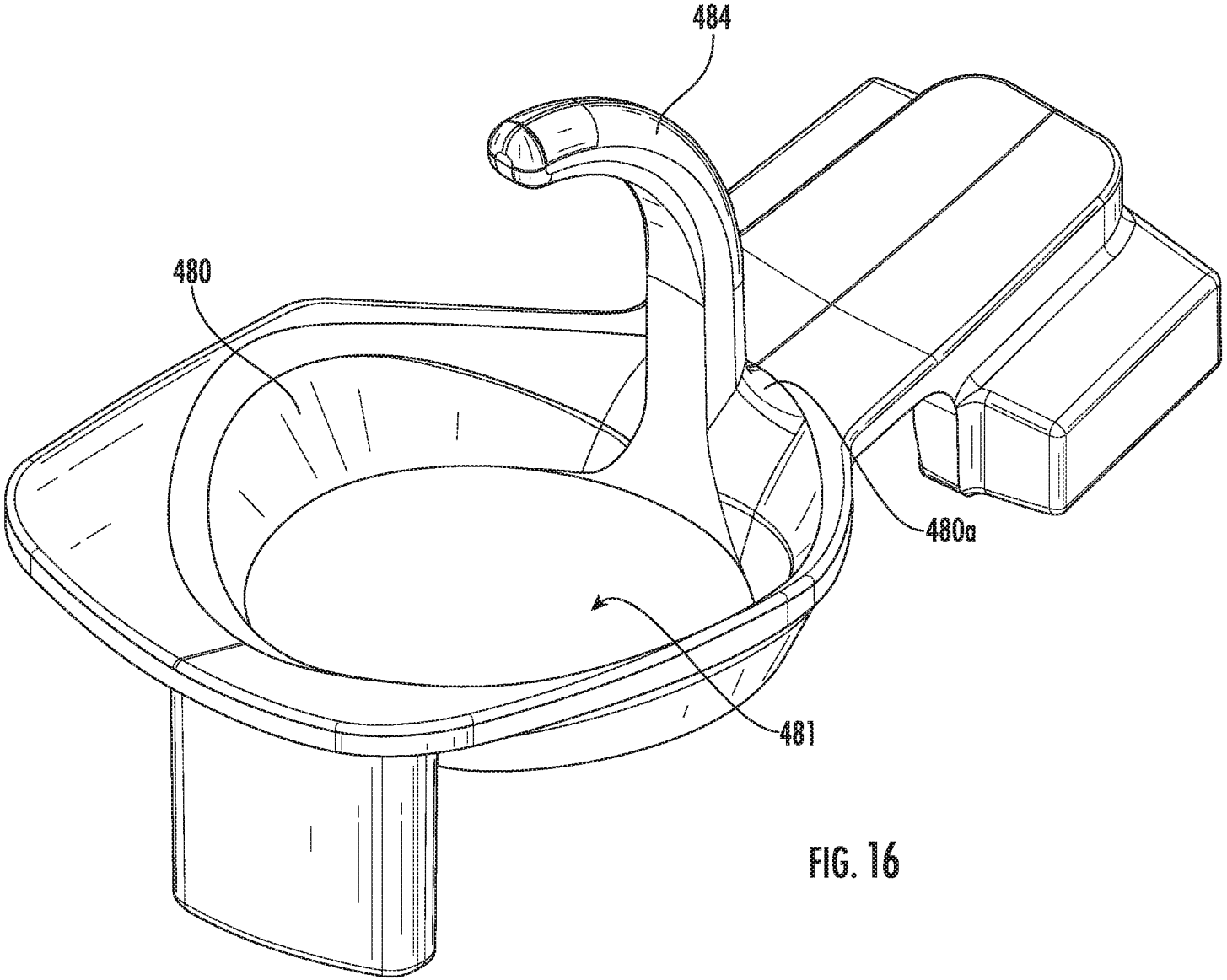
FIG. 16 is a perspective view of an alternative jiggler plate.
Figure 17:
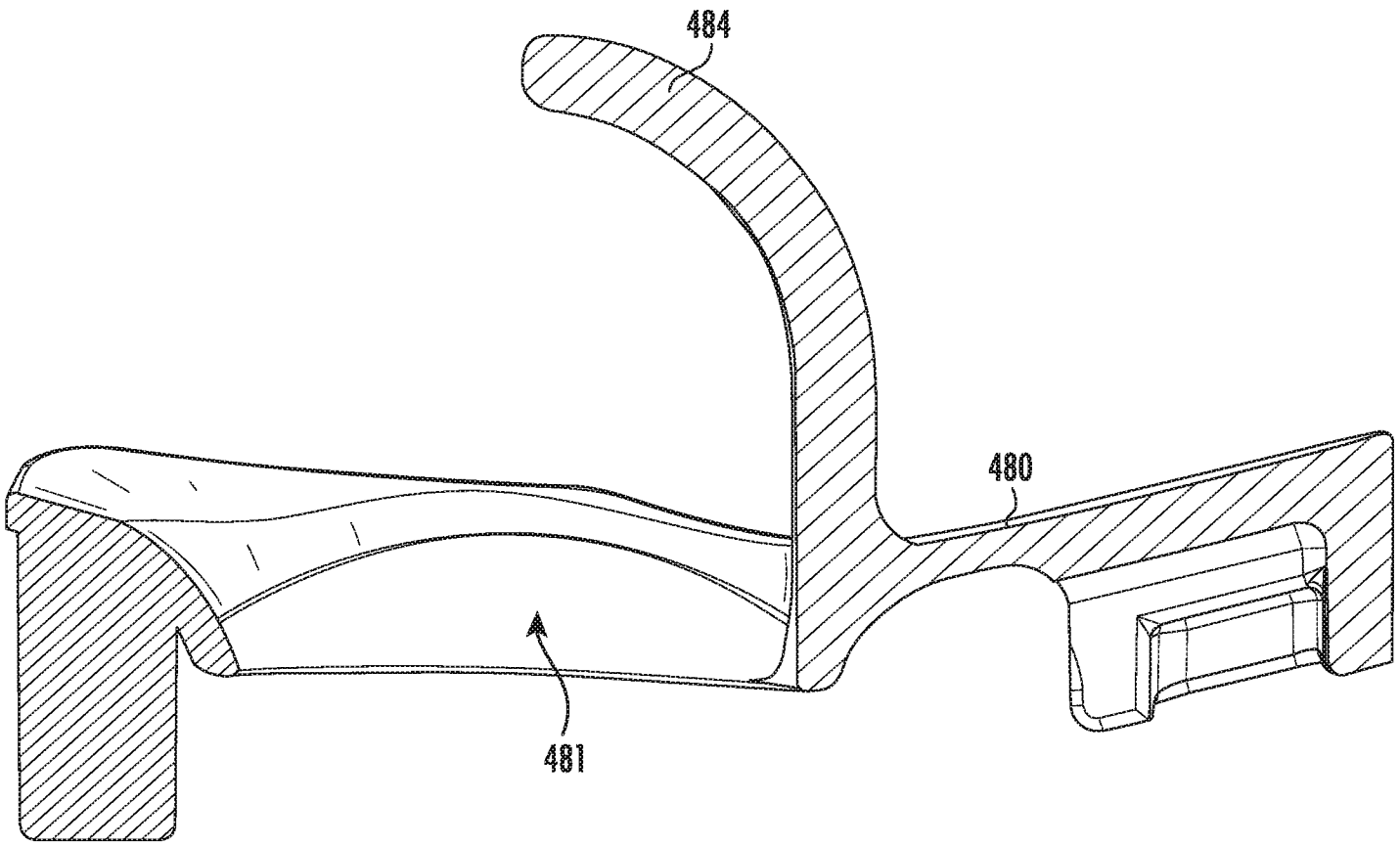
FIG. 17 is a cross-sectional view of the jiggler plate of FIG. 16.

FIGS. 16 and 17 illustrate a further alternative embodiment of a jiggler plate 480. For example, the jiggler plate 480 can be substantially similar to the plate 280 of FIGS. 3-9, but can include a curved protrusion, or hook, 484 extending up from the top of the plate 480 and over the opening 481 of the plate. It can have a substantially upside-down "L" or "J" shape, as shown in FIGS. 16 and 17. While the hook 484 is shown in a first location 480*a* on the plate 480, the hook can be located anywhere around the plate. The protrusion 484 can be shaped, and designed, for reducing blockages of projectiles around the outlet port and provide additional contact points for agitation within the loader. While not illustrated, the curved protrusion 484 can also be used in conjunction with the rubber plate embodiment discussed above and placed on the moveable plate 380*b*.

It will be appreciated by those skilled in the art that various changes and modifications can be made to the illustrated embodiments without departing from the spirit of the present disclosure. All such modifications and changes are intended to be covered by the appended claims.

What is claimed is:

1. A projectile launcher with a gas port, the projectile launcher comprising;

a breech;

a bolt, partially disposed in the breech, the bolt is configured to advance a projectile to a firing position;

a pressurized gas source;

the gas port being disposed in the breech, between a face of the bolt and the projectile when the projectile is in the breech, the gas port is configured and arranged to bleed gas that is used to fire a projectile loaded in the breech; and ancillary equipment that is configured to be actuated by the pressurized gas that is bled through the gas port, wherein the ancillary equipment comprises a mechanical actuator, the mechanical actuator being directly adjacent to the gas port.

2. The projectile launcher of claim 1, wherein the ancillary equipment is directly actuated by the pressurized gas that is bled through the gas port.

3. The projectile launcher of claim 1, further comprising a pneumatic sensor which can be actuated by the pressurized gas that is bled through the gas port.

4. The projectile launcher of claim 3, wherein the pneumatic sensor is configured and arranged to indirectly actuate the ancillary equipment as a function of the pressurized gas that is bled through the gas port.

5. The projectile launcher of claim 3, further comprising a controller configured and arranged to prevent an additional firing of the projectile launcher until the pneumatic sensor is actuated by the pressurized gas that is bled through the gas port.

6. A projectile launcher with a gas port, the projectile launcher comprising, a breech;

a bolt configured to advance a projectile to a firing position;

a pressurized gas source configured to fire a projectile loaded in the breech;

the gas port downstream of the pressurized gas source and disposed through the breech between a face of the bolt and the projectile, when the projectile is loaded in the breech, the gas port being configured and arranged to bleed gas released from the pressurized gas source; and ancillary equipment configured to be actuated by the pressurized gas that is bled through the gas port, wherein the ancillary equipment comprises a mechanical actuator, the mechanical actuator being directly adjacent to the gas port.

7. The projectile launcher of claim 6, wherein the ancillary equipment is directly actuated by the pressurized gas.

8. The projectile launcher of claim 6, further comprising a pneumatic sensor which can be actuated by the pressurized gas.

9. The projectile launcher of claim 8, wherein the pneumatic sensor is configured and arranged to indirectly actuate the ancillary equipment as a function of the pressurized gas.

10. The projectile launcher of claim 8, further comprising a controller configured and arranged to prevent an additional firing of the projectile launcher until the pneumatic sensor is actuated by the pressurized gas.

* * * * *